US005934100A

United States Patent [19]

Hornick

[11] Patent Number: 5,934,100

[45] Date of Patent: Aug. 10, 1999

[54] BEVERAGE KEG COOLING JACKET

[76] Inventor: Robert Hornick, 1180 S. Eaton Cir., #2A, Castle Rock, Colo. 80104

[21] Appl. No.: 09/046,772

[22] Filed: Mar. 23, 1998

[51] Int. Cl.[6] ..... F25D 3/08

[52] U.S. Cl. ..... 62/457.4; 62/371; 62/530

[58] Field of Search ..... 62/371, 372, 457.4, 62/457.2, 457.1, 529, 530

[56] References Cited

U.S. PATENT DOCUMENTS

| | | | |
|---|---|---|---|
| 3,614,875 | 10/1971 | McCallun | 62/372 |
| 4,324,111 | 4/1982 | Edwards | 62/457.4 |
| 4,514,993 | 5/1985 | Johnson | 62/372 |
| 4,653,290 | 3/1987 | Byrne | 62/372 |
| 4,676,247 | 6/1987 | Van Cleve | 128/402 |
| 4,923,077 | 5/1990 | Van Iperen et al. | 220/3.1 |
| 5,269,368 | 12/1993 | Schneider et al. | 165/46 |
| 5,313,807 | 5/1994 | Owen | 62/457.3 |
| 5,361,605 | 11/1994 | Pizzi et al. | 62/530 |
| 5,582,028 | 12/1996 | Rilling et al. | 62/530 |
| 5,595,069 | 1/1997 | Gies | 62/530 |

*Primary Examiner*—Henry Bennett

*Attorney, Agent, or Firm*—Lee G. Meyer; Patton Boggs, LLP

[57] ABSTRACT

An adjustable beverage keg cooling apparatus for cooling various sized beverage kegs of a flexible jacket or wrap for encasing the beverage keg to be cooled. The jacket is adapted to retain refrigerateable gel packs in receptacles or pockets which are integrally embodied in the wrap and form two rows of parallel pockets positioned in substantially symmetrical aligned relationship about the longitudinal central axis of the wrap. The two symmetrical rows of paired parallel vertical pockets extend from the bottom and the top of the beverage keg. In one embodiment, the beverage keg cooling arrangement the wrap is secured about the side wall portion of a beverage keg by means of a hook and fiber fastening means.

8 Claims, 2 Drawing Sheets

BEVERAGE KEG COOLING JACKET

BACKGROUND OF THE INVENTION

1. Field of the Invention

The present invention relates generally to beverage cooling methods and apparatus; and, more particularly to beverage keg cooling apparatus utilizing a refrigerateable cooling material.

2. Description of Related Art

Typical beverage keg cooling is effected by placing the keg within a tub of ice or a mixture of ice and water. The use of a cold pack structure for cooling beverage kegs is shown in the prior art. The idea of a jacket or wrap that can be used in association with cooling a beverage container has been known and described in a number of patents.

For example, U.S. Pat. No. 3,614,875 discloses a disposable beer barrel jacket with four longitudinal pockets used to hold ice. U.S. Pat. No. 5,313,807 discloses the concept of an insulating jacket that has pockets to accept frozen gel packs. U.S. Pat. No. 4,324,111 discloses an insulating wrap with gel pockets to keep an item cool. U.S. Pat. No. 5,595,069 discloses a wrap around insulating wrap with frozen gel as part of the unit to keep an item cold. U.S. Pat. Nos. 5,582,028 and 5,269,368 disclose cooling wraps with longitudinal pockets for frozen gel. In this device refrigerant cases are mounted to upper and lower portions of the housing of the structure. U.S. Pat. No. 4,514,993 indicates a barrel core defining an insulating jacket to be positioned about the side walls of an associated keg structure and the like, wherein the jacket structure includes pockets to receive plastic bags to be filled with water. U.S. Pat. No. 5,361,605 describes a wrap for a standard beer keg containing pockets to accommodate gel packs containing a freezable gel therein. The draw back of these prior art devices is that they cannot accommodate the various sized beverage kegs.

Thus, it would be advantageous to have a beverage keg cooling arrangement which may be easily and efficiently manufactured and marketed, which is of a durable and reliable construction, which is of a design and utility to allow use with any standard size beverage keg, has a carrying strap to make it more portable and is machine washable.

SUMMARY OF THE INVENTION

A beverage keg cooling apparatus comprises an adjustable flexible jacket or wrap for encasing a beverage keg to be cooled, having a set of a plurality of parallel aligned retention means, positioned substantially in symmetrical aligned relationship around the longitudinal central axis of the wrap and adapted to retain refrigerateable material. The wrap is bifurcated about the central longitudinal axis of the wrap to provide adjustable means for retaining two symmetrical rows of cooling material for intimate contact of the cooling material and the keg to be cooled, regardless of the size of the keg, yet provide a single cooling apparatus for either a full size keg or a, so called, "pony" keg.

The beverage keg cooling arrangement of the instant invention provides an adjustable, flexible wrap adapted for removable securement about the side wall portion of a beverage keg, and includes an inner flexible layer, spaced from an exterior flexible layer mounted coextensively with the inner layer, having a plurality of vertical parallel seams directed through the inner layer and the exterior layer to define a plurality of vertical parallel chamber pockets between the inner layer and exterior layer, and a horizontal seam directed through the inner layer and the exterior layer to substantially bifurcate the arrangement, to define two symmetrical rows of aligned vertical parallel chamber pockets between the inner layer and exterior layer about said horizontal seam. Each such pocket defines an opening on the upper portion thereof, and is adopted to receive a plurality of paired refrigerant containers, wherein each of said vertically paired chamber pockets define means to receive an individual one of the refrigerant containers. The two symmetrical rows of paired parallel vertical pockets extend from the bottom and the top of the beverage keg to accommodate gel packs containing a freezable gel. In one embodiment, the beverage keg cooling arrangement contains a hook and fiber fastening means.

In accordance with the invention, an adjustable, flexible wrap arranged for securement about the side wall portion of a beverage keg, is provided wherein the wrap includes two symmetrical rows of parallel vertical pockets such that said pockets extend from the top to the bottom of the keg and are adapted to accommodate gel packs which contain a freezable gel. When a single row of gel packs is employed, the wrap adjusts to be secured about a pony keg, by folding the wrap about the horizontal axis. In one embodiment, the means for securing said wrap is a hook and fiber arrangement disposed laterally on the respective ends of the wrap. In another embodiment the hook and fiber arrangement comprises a plurality of laterally disposed strips to effect an adjustable fastening means.

BRIEF DESCRIPTION OF THE DRAWINGS

The invention will be better understood when consideration is given to the following detailed description thereof. Such description makes reference to the annexed drawings wherein.

DESCRIPTION OF THE PREFERRED EMBODIMENT

Figure 1:
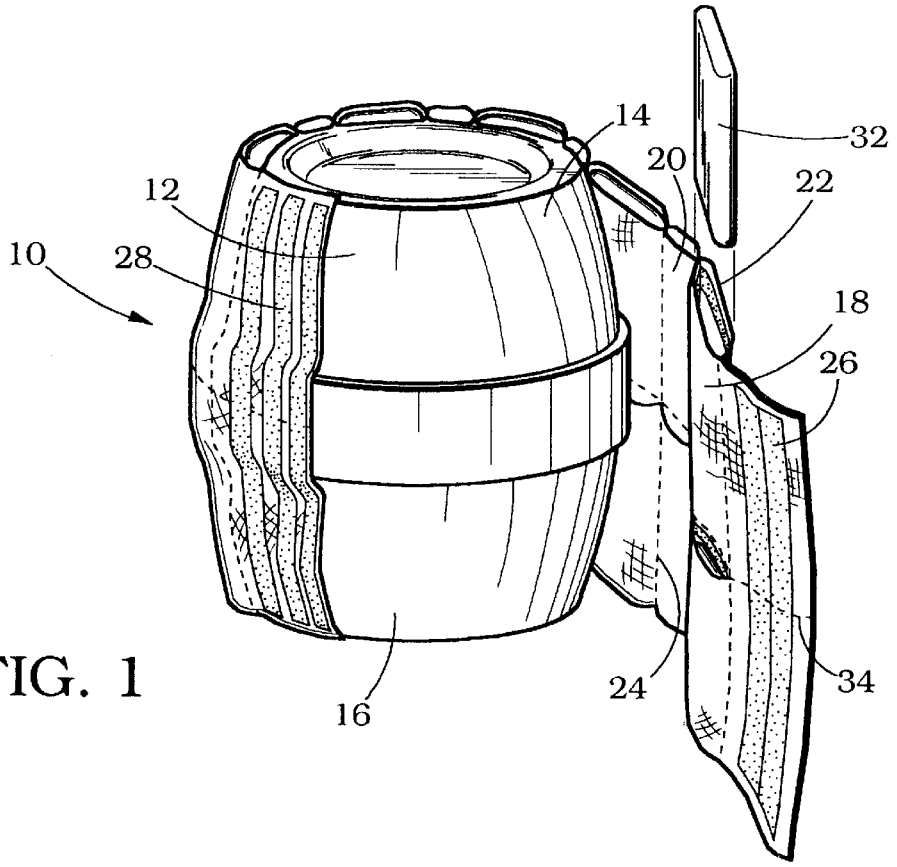
FIG. 1 is an illustration of the invention positioned for application to a keg showing one of the plurality of gel packs in exploded view.

With reference now to the drawings, and in particular to FIGS. 1–4 thereof, a new, adjustable beverage keg cooling arrangement embodying the principles and concepts of the present invention and generally designated by the reference numeral 10 will be described.

More specifically, as shown in FIG. 1 the beverage keg cooling arrangement 10 of the instant invention may be utilized with a standard sized beverage keg 12 having a keg upper wall 14 spaced from a keg lower wall 16. The beverage keg cooling arrangement 10 comprises an adjustable flexible wrap 18 shaped so as extend coextensively with the side wall of beverage keg 12 and is bifurcated alone the horizontal axis by seam 34 as will be more fully described.

Figure 2:
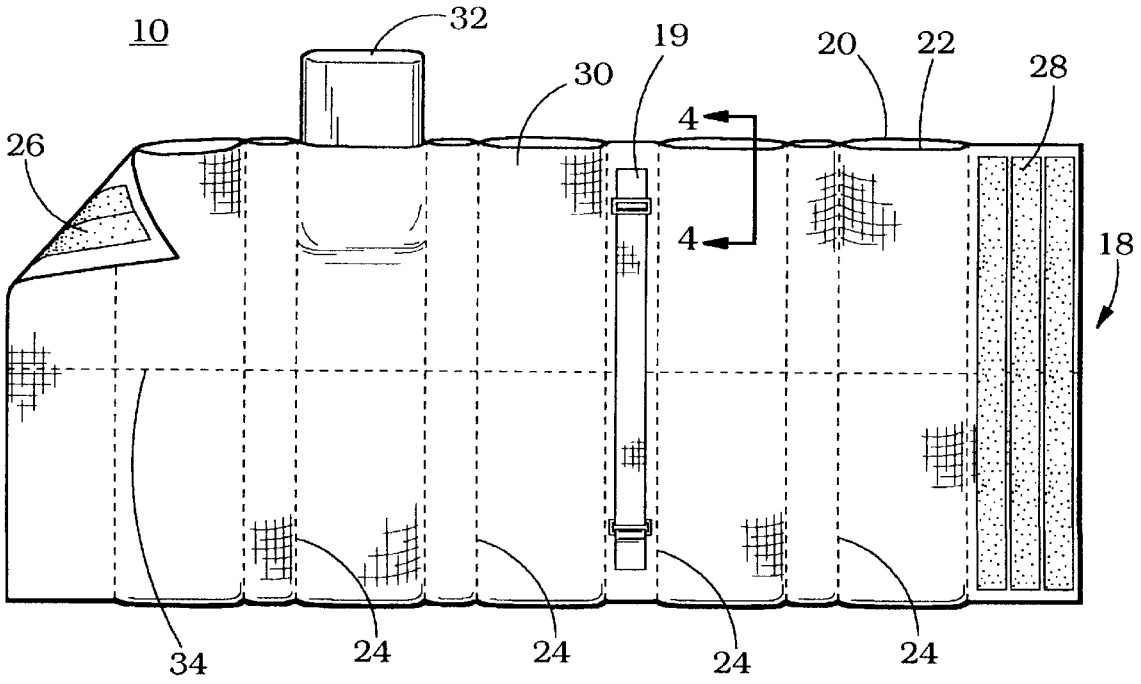
FIG. 2 is an orthographic view of the invention indicating the jacket with the associated carrying handle, fastening straps, and symmetrical, parallel rows of pockets to accept cooling packages.

With reference now to FIG. 2., it can be seen that the adjustable, flexible wrap 18 includes first and second side strips 26 and 28 formed of cooperative hook and loop material which cooperate to permit securement of the wrap about the side wall of keg 12 as illustrated in FIG. 1. A carrying handle 19, is optionally provided, for ease of transporting wrap 18.

The wrap 18 includes a fluid absorbent inner layer 20 (see FIGS. 1 and 4) spaced from a fluid absorbent outer layer 22 to permit absorption of condensed moisture on both the inner and outer layers. Seams 24, arranged in a parallel relationship relative to one another, extend parallel between the first and second side strips 26 and 28 defining chamber pockets 30 between adjacent seams 24.

Each of the chamber pockets 30 is arranged to receive an individual cooling gel filled container 32. As better seen in FIG. 2, two symmetrical sets of parallel pockets 30 are situated facing each other along horizontal line 34 which bifurcates the wrap 18. In the configuration, as depicted in FIG. 1, and better illustrated in FIG. 2, the wrap 18 as fully extended and utilizing both rows of gel packs 32 is adapted to encapsulate a standard keg 12. Accordingly, when wrap 18 is extended to its full width, the pockets 30, and therefore the gel packs 32, are aligned about the horizontal line 34, one atop the other, in a spaced apart parallel relationship.

Figure 3:
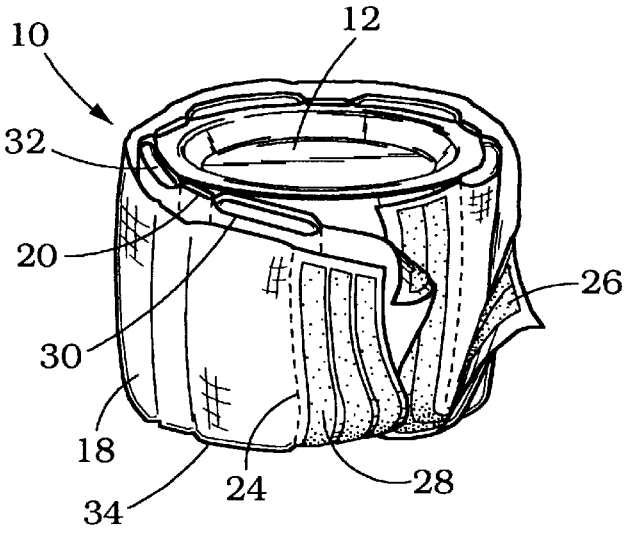
FIG. 3 is an illustration of the invention positioned for application to a pony keg showing one of the plurality of gel packs in exploded view.
Figure 4:
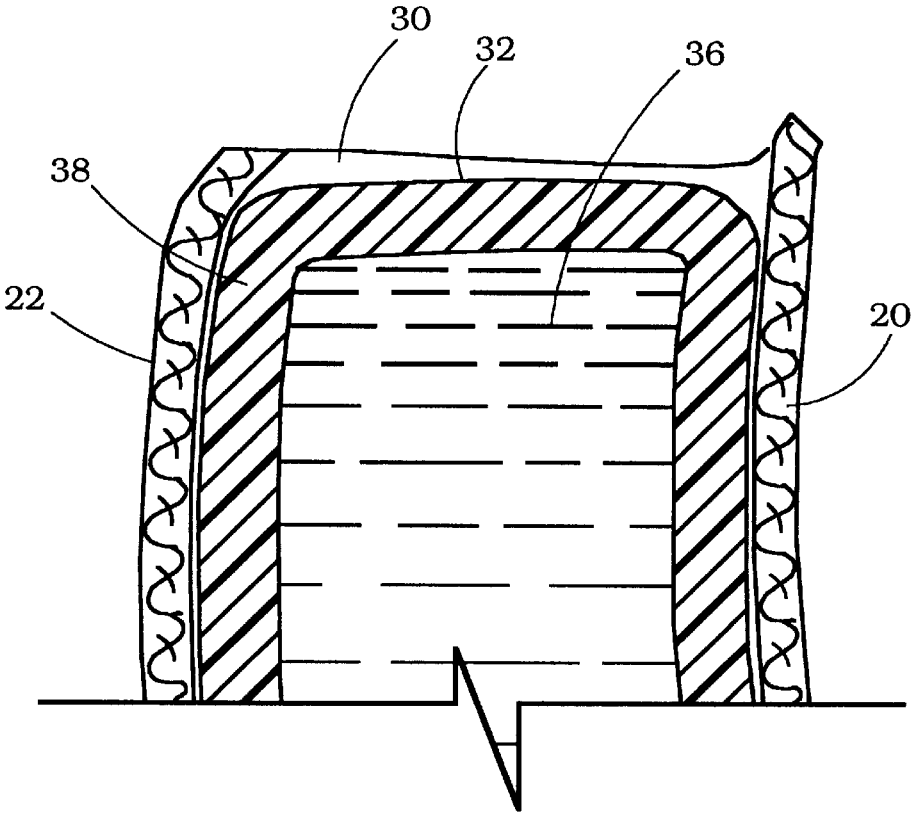
FIG. 4 is a sectional illustration of one aspect of the invention taken through line 4—4 of FIG. 2.

In accordance with the invention, as better seen in FIG. 3, the adjustable cooling keg arrangement 10, containing symmetrical parallel pockets 30, can be folded about the horizontal line 34 to provide a wrap adapted to encase a pony keg. In accordance with this application, the gel packs 32 are situated within only one row of pockets 30 proximate the skin of pony keg 12. In operation the gel packs 32 are inserted into the top half of the wrap 18 and the wrap 18 is, folded over the bottom half of the wrap 18 to accommodate a pony keg 12. The structure of the wrap 18 is shown with gel pack 32 inserted by sectional view in FIG. 4.

Each pocket 30 is formed by stitching through the inner layer 20 and outer layer 22 to form a plurality of seams 24. Each pocket 30 is adapted to house a gel pack 32 having a skin or casing 38 encapsulating a freezable gel material 36. In operation the gel packs 32 are first frozen by suitable means, such as a refrigeration unit, and then placed into the pockets 30. The wrap 18 is then placed around the keg 12 in the afore described manner depending upon the size of the keg 12 and fastened into intimate relationship about the keg 12 by means of hook and loop fastener 26 and 28.

These, together with other various features of novelty which characterize the invention, are pointed out with particularity in the claims annexed to and forming a part of this disclosure. For a better understanding of the advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size materials, shape, form, function and manner of operation, assembly and use, are deemed readily apparent and evident to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable beverage keg cooling apparatus comprising:

a.) flexible wrap, having a longitudinal axis to substantially bifurcate the wrap; and;

b.) a plurality of vertical, parallel chamber pockets, having an opening at one end, forming two rows of parallel pockets, disposed substantially symmetrically on either side of said longitudinal axis, wherein each of said pockets define a means to receive an individual refrigerant container.

2.) The adjustable beverage keg cooling apparatus of claim 1 wherein the pockets are absorbent.

3.) The adjustable beverage keg cooling apparatus of claim 1 wherein the wrap contains means for fastening the wrap about the keg.

4.) The adjustable beverage keg cooling apparatus of claim 3 wherein the means for fastening the wrap about the keg comprises a hook and fiber fastener.

5. An adjustable beverage keg cooling apparatus comprising:

a.) an inner layer;

b.) an exterior layer mounted coextensively with said inner layer spaced from the inner layer;

c.) a plurality of parallel seams directed through the inner layer, and the exterior layer, to define a plurality of parallel chambers between the inner layer and the exterior layer;

d.) a horizontal demarcation along the longitudinal axis of said apparatus, to define two symmetrical rows of a plurality of parallel chamber pockets disposed on either side of said demarcation, between the inner layer and the exterior layer having an opening at one end; and;

e.) a plurality of individual refrigerant containers, contained in each of said chamber pockets wherein each of said chamber pockets defines a means to receive an individual one of said refrigerant containers.

6.) The adjustable beverage keg cooling apparatus of claim 5 wherein the inner flexible layer is absorbent.

7.) The adjustable beverage keg cooling apparatus of claim 5 wherein the outer flexible layer is absorbent.

8.) The adjustable beverage keg cooling apparatus claim 5 further comprising a hook fastener first side strip spaced from a loop fastener second side strip.

* * * * *